US008342626B2

(12) United States Patent
Kawamata et al.

(10) Patent No.: US 8,342,626 B2
(45) Date of Patent: Jan. 1, 2013

(54) INK JET RECORDING APPARATUS AND DISCHARGE RECOVERY METHOD

(75) Inventors: Yutaka Kawamata, Tokyo (JP); Taku Yokozawa, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 938 days.

(21) Appl. No.: 11/753,741

(22) Filed: May 25, 2007

(65) Prior Publication Data

US 2007/0291074 A1 Dec. 20, 2007

(30) Foreign Application Priority Data

Jun. 16, 2006 (JP) ..... 2006-168009

(51) Int. Cl.
*B41J 11/00* (2006.01)

(52) U.S. Cl. ..... 347/14; 347/19

(58) Field of Classification Search ..... 347/19, 347/14
See application file for complete search history.

(56) References Cited

U.S. PATENT DOCUMENTS

| | | | | |
|---|---|---|---|---|
| 5,583,547 | A | 12/1996 | Gast et al. | 347/22 |
| 5,781,204 | A | 7/1998 | Kanematsu et al. | 347/17 |
| 6,193,351 | B1 | 2/2001 | Yaegashi et al. | |
| 2003/0146945 | A1* | 8/2003 | Inui et al. | 347/7 |
| 2006/0197799 | A1 | 9/2006 | Sato et al. | |
| 2006/0203034 | A1* | 9/2006 | Uetsuki et al. | 347/33 |

FOREIGN PATENT DOCUMENTS

| | | | |
|---|---|---|---|
| JP | 2-141248 | A | 5/1990 |
| JP | 4-358846 | A | 12/1992 |
| JP | 8-58115 | A | 3/1996 |
| JP | 9-207358 | | 8/1997 |
| JP | 2001-121717 | | 5/2001 |
| JP | 2001121717 | A * | 5/2001 |
| JP | 2003-231265 | A | 8/2003 |

* cited by examiner

*Primary Examiner* — Laura Martin
(74) *Attorney, Agent, or Firm* — Fitzpatrick, Cella, Harper & Scinto

(57) ABSTRACT

An ink jet recording apparatus determines the timing of executing discharge recovery processing based on the discharge amount of ink for each predetermined region discharged from a recording head, and controls the discharge recovery processing to be executed at the determined timing. Thereby, the discharge performance of the ink can be kept to be good, and the discharge recovery processing can be executed at the suitable timing without producing any deterioration of the image quality of a recorded image, and with the deterioration of throughput reduced.

10 Claims, 7 Drawing Sheets

FIG. 7

| DUTY | 10% | 20% | 30% | 40% | 50% | 60% | 70% | 80% | 90% | 100% |
|---|---|---|---|---|---|---|---|---|---|---|
| COEFFICIENT | 0.01 | 0.05 | 0.1 | 0.4 | 0.7 | 1 | 1 | 1 | 1 | 1 |

FIG. 8

| NUMBER OF PASSES | CR SPEED | RESOLUTION | COEFFICIENT |
|---|---|---|---|
| 1 | 40inch/sec | 1200 | 1.2 |
| 1 | 25inch/sec | 1200 | 1 |
| 2 | 40inch/sec | 1200 | 0.8 |
| 2 | 25inch/sec | 1200 | 0.7 |
| 4 | 40inch/sec | 1200 | 0.3 |
| 4 | 33inch/sec | 1200 | 0.25 |
| 4 | 25inch/sec | 1200 | 0.2 |
| 6 | 40inch/sec | 1200 | 0.12 |
| 6 | 33inch/sec | 1200 | 0.12 |
| 6 | 25inch/sec | 1200 | 0.12 |
| 8 | 33inch/sec | 2400 | 0.08 |
| 12 | 33inch/sec | 2400 | 0.07 |
| 16 | 33inch/sec | 2400 | 0.06 |

| DISTANCE FROM SHEET | Low | Mid | High |
|---|---|---|---|
| COEFFICIENT | 0.7 | 0.8 | 1.0 |

| BREADTH OF TEMPERATURE RISE | LESS THAN 10 ℃ | 10～20℃ | 20～30℃ | NOT LESS THAN 30 ℃ |
|---|---|---|---|---|
| COEFFICIENT | 0.3 | 0.6 | 0.9 | 1.0 |

INK JET RECORDING APPARATUS AND DISCHARGE RECOVERY METHOD

BACKGROUND OF THE INVENTION

1. Field of the Invention

The present invention relates to an ink jet recording apparatus and a discharge recovery method, and more particularly to the execution timing of discharge recovery processing executed for keeping the discharge performance of a recording head to be good.

2. Description of the Related Art

A recording apparatus having the functions of a printer, a copier, a facsimile, and the like, and a recording apparatus used as the output equipment of a computer, a word processor, a work station, and the like have been known. These recording apparatus are adapted to record an image (including a character, a sign, and the like) on a recording medium such as a sheet of paper and a plastic thin plate (such as an OHP sheet) based on image information. Among the recording apparatus of this kind, a serial type recording apparatus adopting a recording system of performing the main scan thereof in the direction intersecting with the conveyance direction of the recording medium (sub scan direction) is widely used. The system records an image with a recording head mounted on a carriage moving along the recording medium (main scan), and performs a predetermined quantity of paper feed (sub scan) after the end of the recording for one scan. By repeating the main scan of the recording head and the sub scan of the recording medium, the image can be recorded in a desired range on the recording medium.

The systems of the recording head include an ink jet system, a wire-dot system, a thermosensitive system, a thermal transfer system, a laser beam system, and the like. The ink jet system among them discharges ink from a recording head to a recording medium to perform recording, and can easily makes the recording head compact and can record a highly fine image at a high speed. Moreover, the ink jet system has the following advantages: the system can perform recording on a sheet of plain paper without needing any special processing; the running cost thereof is inexpensive; noises are little owing to being a non-impact system; and a color image can be easily recorded using multi-color ink; and the like.

The recording head of the system of discharging ink using thermal energy among the ink jet systems is especially manufactured by forming an electrothermal transducer, electrodes, liquid path walls, a top plate, and the like on a substrate through a semiconductor manufacturing process including etching, vapor deposition, sputtering, and the like. From this manufacturing method, the recording head having a high density discharge port arrangement can be easily manufactured, and the recording head can be formed to be more compact. Moreover, the recording unit of the recording head can be easily formed to have a long size or to be a plane (to have two dimensions) by utilizing the advantages of an IC technology and a micro working technology, and the recording unit can be also easily fully multiplied and mounted in high density.

The ink jet recording head like this arranges its discharge ports at a pitch of, for example, 1/600 inches or 1/2400 inches. In the recording head like this, ink sometimes attaches on a discharge port surface owing to ink mist produced at the time of ink discharge or splashes produced by the impact produced when the discharged ink reaches the recording medium. In this case, the attached ink sometimes obstructs the discharge ports to generate a defective discharge. Accordingly a configuration for removing the ink attached to the circumferences of the discharge ports by wiping out the ink by providing a blade made of an elastic body such as rubber and moving the recording head with the blade abutting against the discharge port surface of the recording head. This is known as wiping, and one of the discharge recovery processings for keeping the discharge performance of the recording head in a good state.

Moreover, the so-called preliminary discharge is known as another mode of the discharge recovery processing. The preliminary discharge performs an ink discharge that does not participate in the recording of an image from the recording head at a predetermined position of the apparatus. A thickened ink is ejected from the inside of an ink flow path to prevent the defective discharge beforehand. At the time of recording, ink is selectively discharged from a plurality of discharge ports of the recording head to form an image. If individual discharge ports are examined, some of them do not perform any discharges of ink according to some image data, so that the ink remains being exposed to the open air to some image data. The viscosity of the ink remaining in the discharge ports like this increases, and thereby a defective discharge such as the decrease of the amount of discharged ink and the deflection of a discharge direction may occur. The defective discharge like this can be prevented beforehand by performing the preliminary discharge periodically.

The so-called absorption recovery processing is known as a still other mode of the discharge recovery processing. The recovery processing absorbs ink and ejects the ink from the discharge ports by capping the discharge port surface of the recording head and producing a negative pressure in the cap. The recovery processing ejects the bubbles staying particularly in an ink path and a common liquid chamber together with ink.

The timing of executing the discharge recovery processing mentioned above is frequently based on factors such as a discharge frequency and an environmental temperature, and the discharge recovery processing is executed at the timing when the factors satisfy the conditions in which the recovery processing becomes necessary. Japanese Patent Application Laid-Open No. H09-207358 describes one example of the discharge recovery processing. The Japanese Patent Application Laid-Open No. H09-207358 describes that the interval between the performance of the preliminary discharge is determined according to the degree of temperature rise of a recording head. Moreover, the Japanese Patent Application Laid-Open No. H09-207358 describes that the number of times (the number of dots) of the discharges for one page is counted every end of recording for one page, and that, if the number of times is a predetermined value or more, absorption recovery is performed. Moreover, the Japanese Patent Application Laid-Open No. H09-207358 also describes that the counted number of dots is corrected at this time according to an environmental temperature and the degree of temperature rise.

Now, as described above, the determination of the execution timing of the conventional discharge recovery processing is uniformly executed when the discharge recovery processing satisfies the necessary condition. For example, if the degree of temperature rise is that of making the thickening of ink reach a value near to the limit of producing a defective discharge, the preliminary discharge is executed. Or, if discharges have been performed by the number of dots at which it can be presumed that a staying bubble has grown up to the size that influences a discharge, the absorption recovery is executed.

However, such method of determining the execution timing of the discharge recovery processing is uniform, and as a result, unnecessary recovery processing is sometimes performed. In particular, the degree of the contamination of the discharge port surface of a recording head, which is an object of wiping, relatively changes owing to the duty (density) of recording dots and a drive frequency. Consequently, wiping is sometimes preformed at unnecessary timing in some contaminated state of the discharge port surface.

As a result, the conventional discharge recovery has a problem with the lowering of throughput by the relatively frequent wiping operations. Moreover, there are some cases where the frequent wiping operations cause deterioration of the image quality of a recorded image. That is, if the wiping is frequently performed, there are some cases where a difference in the density or the tint that can be produced between the images of the bands formed by the scans before and after the wiping becomes remarkable to deteriorate the image quality. In concrete terms, the time interval from the end of the scan just before wiping to the start of the scan just after the wiping is longer than the time interval of the scans without any wiping operations put between them, and an image that has a part where the density or the tint is different from that in the other parts according to the longer time interval is formed. For example, in the case of one path recording, stripe-like density unevenness can be produced at the boundary between the bands before and after wiping, or the degree of generation of the stripe-like density unevenness can differ from that at the other parts. Moreover, especially in the one-path recording, the influences exerted on the following scans by cockling, which can be produced by a scan, can become larger after the elapsing of a relatively long time with intervening wiping. The difference of density may be produced by the influences of the cockling. Moreover, in multi-path recording for performing recording in a determined region by a plurality of times of scans, the time interval between scans before and after wiping is similarly longer than that of scans without intervening any wiping operations, and an image that has a part where the tint is different from that in the other parts according to the longer time interval is formed.

As described above, the discharge recovery processing such as wiping especially has a problem with density unevenness, a tint, and the like caused by the discharge recovery processing if the discharge recovery processing is simply uniformly executed at the timing satisfying the conditions necessary for the discharge recovery processing.

SUMMARY OF THE INVENTION

It is an object of the present invention to provide an ink jet recording apparatus and a discharge recovery method, each capable of keeping the discharge performance in a good state, nor producing deterioration of the image quality of a recorded image, and executing discharge recovery processing at suitable timing without no deterioration of throughput.

For that purpose, according to the present invention, an ink jet recording apparatus for performing recording using a recording head for discharging ink, by discharging the ink from the recording head to a recording medium includes a recovery unit for performing discharge recovery processing for keeping the discharge performance of the recording head, and a control unit for determining the execution timing of the discharge recovery processing by the recovery unit based on a discharge amount of the ink for each predetermined region discharged from the recording head to control to execute the discharge recovery processing at the determined timing.

Moreover, a discharge recovery method for performing discharge recovery processing for keeping the discharge performance of a recording head in an ink jet recording apparatus for performing recording using the recording head for discharging ink, by discharging the ink from the of recording head to a recording medium determines the execution timing of the discharge recovery processing based on a discharge amount of the ink for each predetermined region discharged from the recording head to control to execute the discharge recovery processing at the determined timing.

According to the configurations described above, the amounts of a recoding operation such as the counted value of recording dots, which amounts basically determine the execution timing of recovery processing, are corrected according to recording operation conditions such as recording dot density and a drive frequency. Even if the quantity of the recoding operations before correction becomes the quantity requiring the discharge recovery processing, the actual states of the recording head cannot need the execution of the discharge recovery processing, in some cases. In such a case, the execution of unnecessary discharge recovery processing can be avoided.

As a result, the discharge performance of the recording head can be kept to be good, and the discharge recovery processing can be executed at suitable timing without producing any deterioration in the image quality of a recorded image and without any deterioration in any throughputs.

Further features of the present invention will become apparent from the following description of exemplary embodiments with reference to the attached drawings.

BRIEF DESCRIPTION OF THE DRAWINGS

FIG. 7 is a diagram illustrating a table illustrating the relation between dot duties and correction coefficients according to the first exemplary embodiment.

FIG. 8 is a diagram illustrating a table illustrating the relation between record modes and the correction coefficients according to the first exemplary embodiment.

DESCRIPTION OF THE EMBODIMENTS

In the following, the exemplary embodiments of the present invention will be described in detail with reference to the attached drawings. Incidentally, it is a matter of course that the embodiments of the present invention are not limited to the exemplary ones that will be described in the following.

First Exemplary Embodiment

Figure 1:
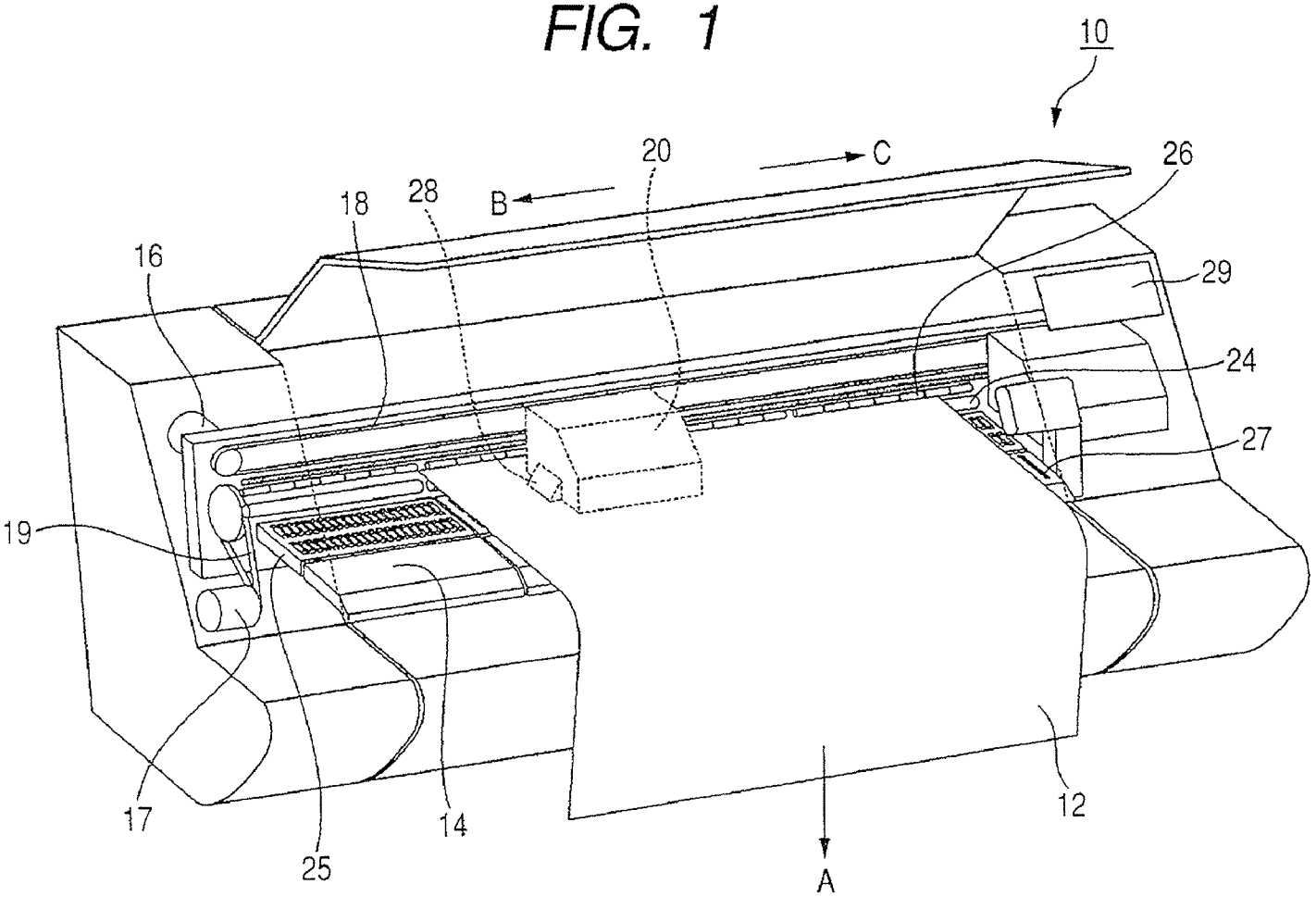
FIG. 1 is a perspective view illustrating an ink jet printer according to an exemplary embodiment of the present invention.

FIG. 1 is a perspective view illustrating an ink jet printer according to an exemplary embodiment of the present invention.

In FIG. 1, a recording medium 12 is conveyed into the direction of an arrow A, and at this time the recording surface of the recording medium 12 is regulated by a platen 14 provided correspondingly to a recording region by a recording head mounted on a carriage 20. Two scan rails (not illustrated) are provided in parallel to the platen 14 above the platen 14. The carriage 20 is attached to the scan rails with a slide bearing (not shown). Consequently, the carriage 20 can reciprocally moves into the directions indicated by arrows B and C (the directions perpendicular to the direction of the arrow A) with a belt 18 transmitting driving force of a motor 16. A linear scale (not shown) is provided along a transfer pathway of the carriage 20. Slits for detecting the position of the carriage 20 are formed in the linear scale. Moreover, an optical sensor (not shown) for reading the slit of the linear scale is mounted on the carriage 20. The position of the carriage 20 in the directions of the arrows B and C can be detected by counting the pulses output from the optical linear scale sensor. Moreover, the ink discharge timing of the recording head can be determined based on the pulses. Incidentally, the initialization of the pulse count is performed by moving the carriage 20 to the position of a home position (HP) sensor (not shown) at the ends of the scan rails at the time of turning on the power source. Furthermore, a reflective optical sensor 28 is mounted on the carriage 20, and the end of the recording medium 12 is detected with the reflective optical sensor 28 as it will be described later.

Figure 2:
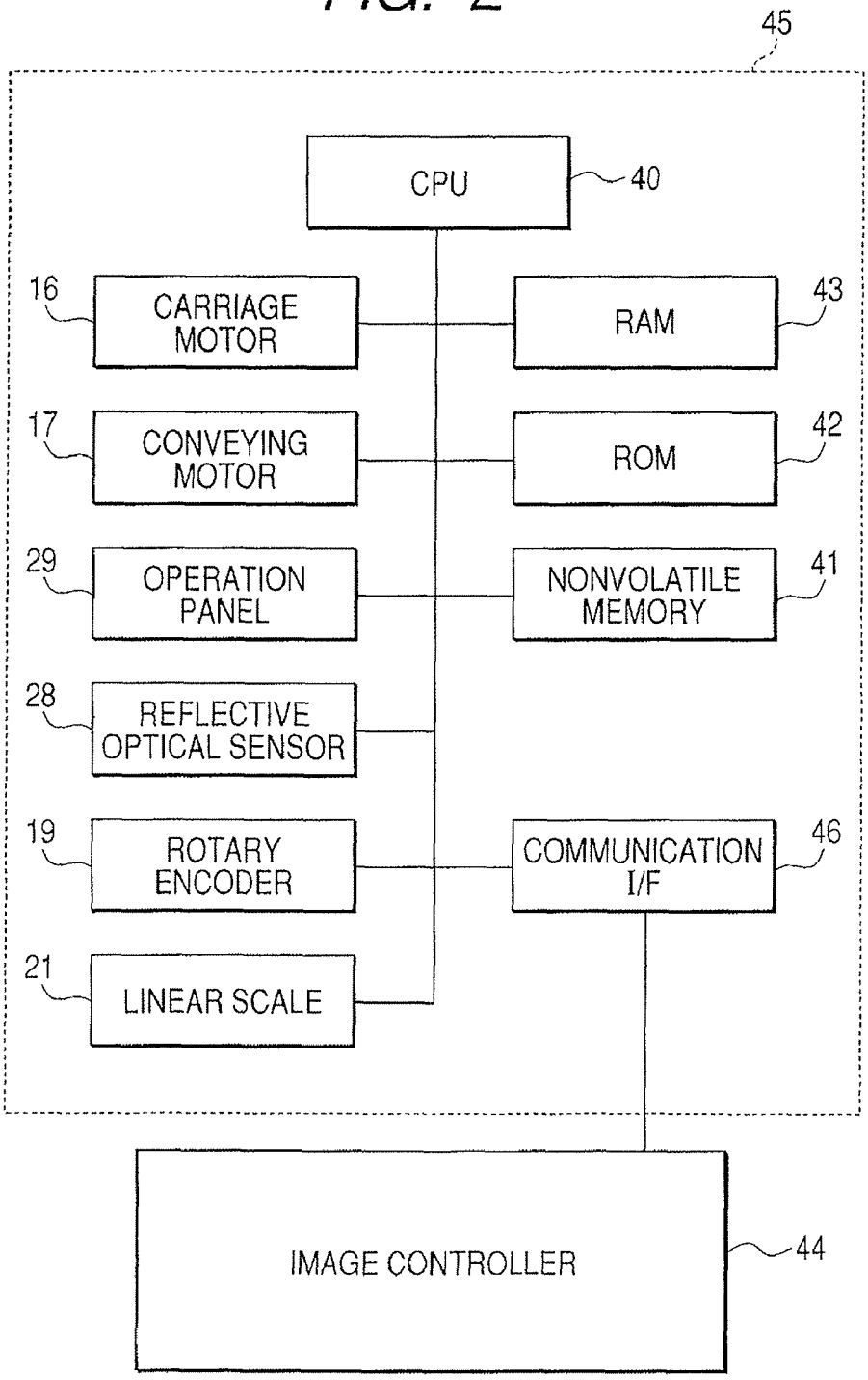
FIG. 2 is a block diagram illustrating the control configuration of the ink jet printer illustrated in FIG. 1.

FIG. 2 is a block diagram illustrating the control configuration of a printer 10 illustrated in FIG. 1. The printer 10 is provided with a central processing unit (CPU) 40 for the program control of the operations and the processing of a mechanism in the apparatus. Moreover, the printer 10 is provided with a ROM 42 storing programs that the CPU 40 executes, data and the like, a nonvolatile memory 41 storing parameters peculiar to the printer 10, various kinds of data such as drive conditions, and the like, a RAM 43 providing a working area, a temporary holding area, and the like in program processing. As the nonvolatile memory 41, an arbitrary memory device such as a flash memory, a battery backup memory, EEPROM and the like can be used. The printer 10 is further provided with an operation panel 29 for receiving various operation instructions of a user and for informing various kinds of information to the user. The operation panel 29 can include a display such as a liquid crystal panel for displaying a message and the like or lamps such as LED's functioning as an indicator, and various keys for transmitting instructions. Moreover, the printer 10 is provided with the carriage motor 16 for driving the carriage 20, a medium conveying motor 17 for conveying the recording medium 12, a rotary encoder 19 annexed to the conveying motor 17, and the reflective optical sensor 28. The hardware portion of them is called as an engine controller 45, and chiefly bears the role of driving/controlling the hardware such as the motors, the head, and the like.

The engine controller 45 also controls the operation and the timing of the discharge recovery processing, which will be described with reference to FIG. 6 and the like.

The image processing of image data and the like, protocol processing for the connection with a net work, communication processing with a host computer, and the like are executed by an image controller 44. The image controller 44 operates by mutually communicating raster data subjected to image processing, command data for asking/responding an operation, and the like with the engine controller 45 through a communication I/F 46. The image controller 44 is adapted to include a CPU different from the CPU 40, and to parallelly operate to the engine controller 45 so that the whole throughput may be improved.

An outline of the operation of the printer 10 of the present exemplary embodiment including the aforesaid control configuration will be described.

Before the execution of image recording, the recording medium 12 such as roll paper is supplied and conveyed to the position of the platen 14; the size of the recording medium 12 is measured; and a recordable range is detected. Next, a conveying roller 24 is rotated by the medium conveying motor 17 and then the recording medium 12 is conveyed, with being pinched by (1) the conveying roller 24, a part of the circumference surface of which is exposed from an aperture portion formed in the platen 14, and (2) pinch rollers 26, which holds down the recording medium 12 from the upper part thereof. The conveyance is then preformed until the end of the recording medium 12 projects from the platen 14. Moreover, the recording head mounted on the carriage 20 is moved by a distance (30 mm here) shorter than the minimum recording medium size (ISO A4: 210 mm×297 mm) from the recording medium placing reference position 27 in the direction of the arrow B.

Next, the conveying roller 24 is reversed, and thereby the recording medium 12 is conveyed into the opposite direction to the conveyance direction (sub scan direction) of the arrow A until the reflective optical sensor 28 installed in the carriage 20 detects the platen 14. At the beginning, the reflective optical sensor 28 detects the recording medium 12. But, by conveying the recording medium 12 in the opposite direction to the conveyance direction (reverse conveyance), the reflective optical sensor 28 can detect the platen 14. Because the position where the reflective optical sensor 28 detects the platen 14 is the end position of the conveyance direction of the recording medium 12, the position is stored in the memory 41.

Next, the recording medium 12 is conveyed into the direction of the arrow A by a predetermined distance (100 mm in the present exemplary embodiment), and the carriage 20 is moved into the direction of the arrow C to a position out of the recording medium placing reference position 27. After that, the carriage 20 is moved into the direction of the arrow B at a definite speed. While moving, the carriage 20 measures the output value of the reflective optical sensor 28, and the position where the reflective optical sensor 28 detects the same light quantity as the reflected light quantity from the recording medium 12 is stored because the position is the end on the side of the recording medium 12 in the direction of the arrow C (reference position 27). Moreover, when the reflective optical sensor 28 continues to perform the detection while the carriage 20 continues to move, the reflective optical sensor 28 detects the platen 14. Because the position where the reflective optical sensor 28 detects the platen 14 is the end of the recording medium 12 on the side of the direction of the arrow B, the position is also stored.

By the processing described above, the end position of the recording medium 12 placed on the platen 14, and both side ends (width) are determined. Thereby recording can be performed. The operation is called as load processing, and is performed when a medium is newly installed in the printer 10.

When an image is recorded on the recording medium 12, the recording medium 12 is placed on the platen 14, and the carriage 20 is reciprocally moves into the directions of the arrows B and C at an upper part of the recording medium 12. A scan of the recording head is then performed. The raster data transmitted from the image controller 44 is then subjected to the data conversion into the direction of the head nozzle row, and the converted data is sequentially transmitted to a head control unit (not shown) in synchronization with the count pulses of a linear scale 21. Ink is discharged from the nozzles based on an image signal including the image information transmitted from the head control unit to the recording head, and a belt-shape (band-like) image is formed on the recording medium 12. While the recording medium 12 is sequentially moved by a predetermined quantity, the belt-shape image like this is repeatedly formed. Thereby recording for one page is ended. When the recording for one page has ended, a cutter (not shown) is projected up to a predetermined position in a cutter guide 25 mounted on the carriage 20, and the carriage 20 is moved. The recording medium 12 is thereby cut out to a predetermined size.

Figure 3:
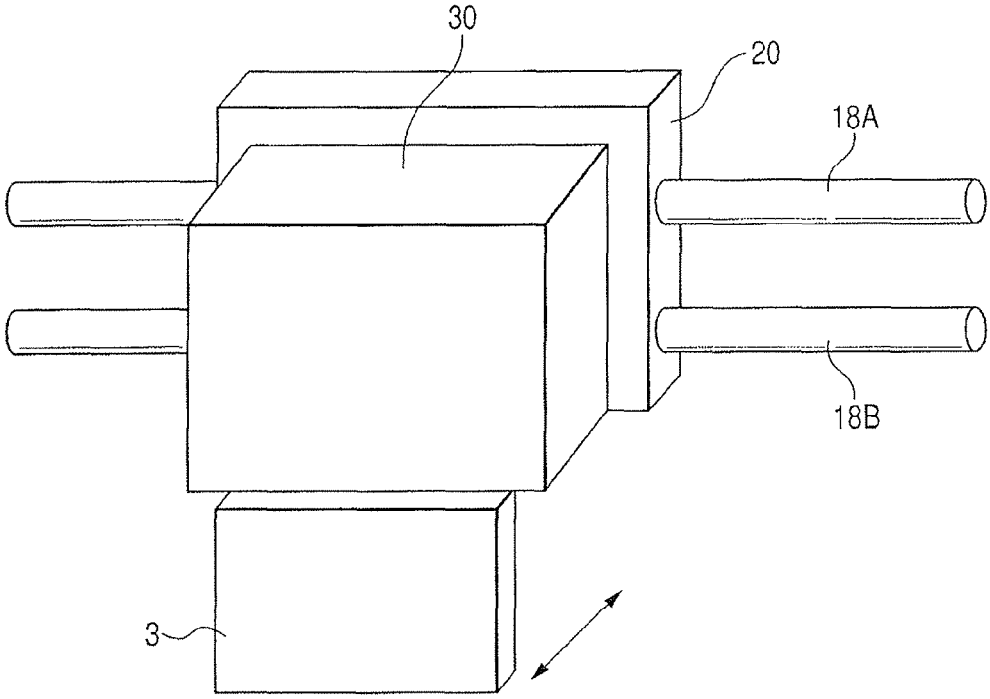
FIG. 3 is an enlarged view illustrating the circumference of the recording head of the ink jet printer illustrated in FIG. 1.

FIG. 3 is a view illustrating the carriage 20 illustrated in FIG. 1 and the circumference thereof in their enlarged states. The carriage 20 is supported by the scan rails 18A and 18B and can move in the horizontal direction in the figure. The recording head 30 is mounted on the carriage 20, and also ink tanks each filled up by a black ink, a cyan ink, a magenta ink, and a yellow ink are mounted. Moreover, a wiper blade 3 is provided at a predetermined position (for example, a position corresponding to an end) in the movement region of the carriage 20 (recording head 30). The wiper blade 3 is provided to be movable so that the wiper blade 3 may abut against a nozzle formation surface (also called as a discharge port surface), on which the nozzles of the recording head 30 are formed, by a not shown mechanism and can perform the operation of wiping the nozzle formation surface.

Figure 4:
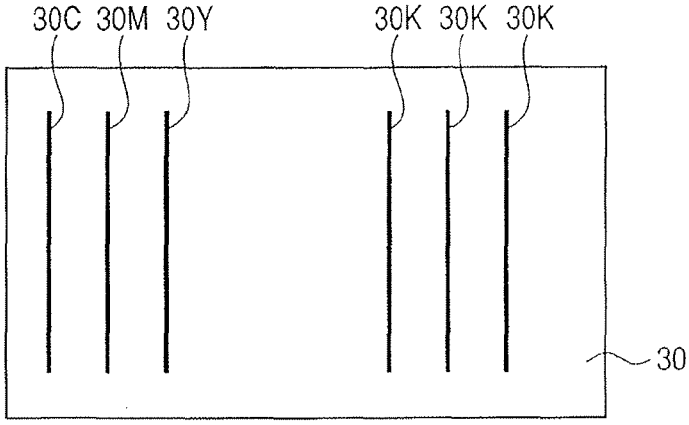
FIG. 4 is a view illustrating a discharge port surface of the recording head illustrated in FIG. 3.

FIG. 4 is a schematic view illustrating the discharge port surface of the recording head 30. The recording head 30 is provided with a plurality of nozzle rows, in each of which a plurality of nozzles are arranged, and the plurality of nozzle rows are composed of nozzle rows 30C, 30M, 30Y, and 30K discharging a cyan (C) ink, a magenta (M) ink, a yellow (Y) ink, and a black (K) ink, respectively. As illustrated in the same figure, the present exemplary embodiment includes three nozzle rows of the black ink.

Figure 5:
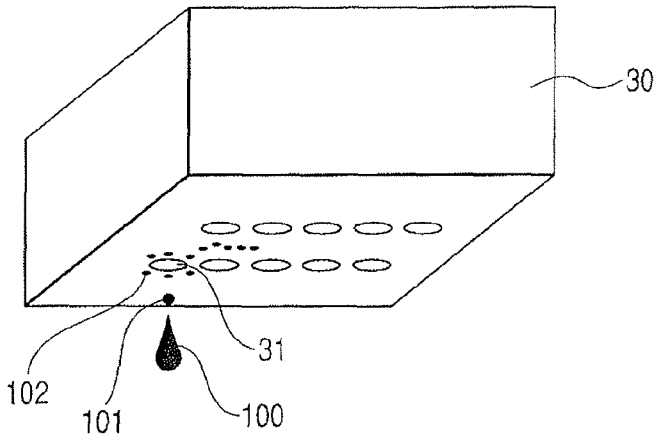
FIG. 5 is a view illustrating the state of the discharge port surface at the time of the recording of the recording head illustrated in FIG. 3.

FIG. 5 is a view schematically illustrating an example of a state of the discharge port surface of the recording head 30 during a recoding operation. When an ink drop 100 is discharged from a nozzle 31, a mist 101 (also called as a satellite) is produced besides the ink drop 100.

Parts of the mist 101 adhere to the discharge port surface of the recording head 30 to produce mist contaminations 102 owing to an air current occurring in the printer 10. Moreover, the mist contaminations 102 are also produced by the rebounds of the parts of the discharged ink drops from the recording medium 12. If the ink drop 100 is discharged in the state in which the mist contaminations 102 are produced, then a defective discharge of the displacement of the impact position of the ink drop 100 occurs. Accordingly, in order to keep the discharge state of ink from the nozzles in a good state, the execution of wiping to wipe the discharge port surface on which the mist contaminations 102 are produced is performed.

The wiping timing determination processing using the wiper blade 3 in the printer 10 of the present exemplary embodiment having the configuration described above will be described in the following.

Figure 6:
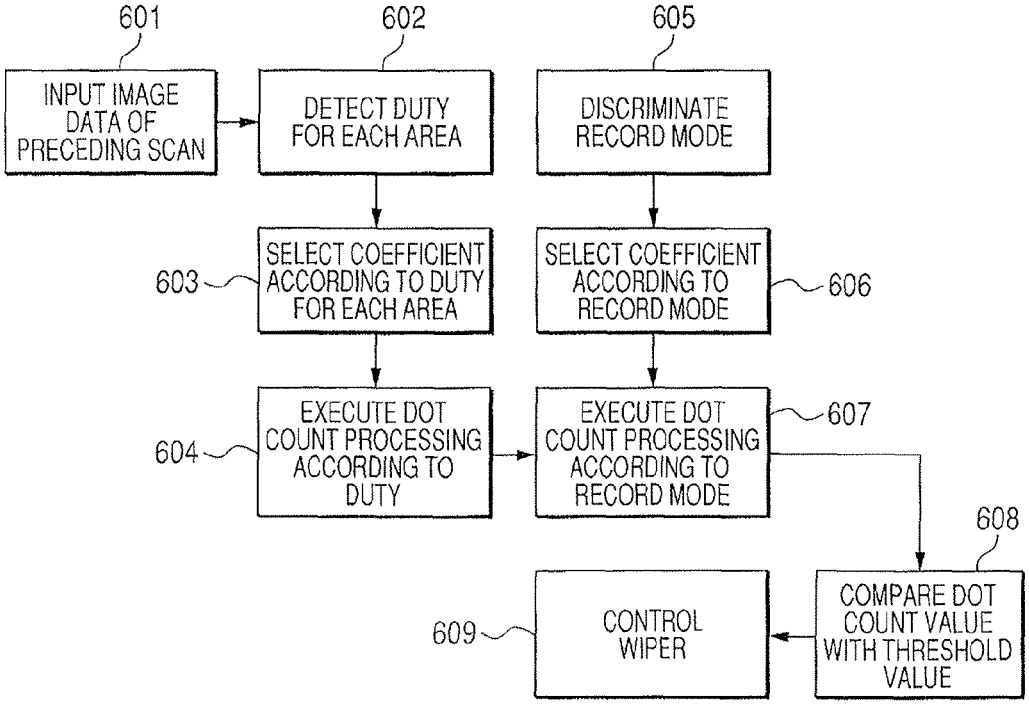
FIG. 6 is a block diagram illustrating the processing or the configuration for determining the execution timing of wiping, one of discharge recovery processings according to a first exemplary embodiment of the present invention.

FIG. 6 is a block diagram illustrating the processing or the configuration for determining the execution timing of wiping, which is one of the discharge recovery processings of the first exemplary embodiment of the present invention.

The processing illustrated in FIG. 6 is performed every scan of the recording head 30, and ends until the next scan starts. That is, when the present processing is executed and the execution of wiping is determined as described below, the recording head 30 is moved to the position where the wiper blade 3 is provided before the next scan starts, and the wiping is executed.

In the present exemplary embodiment, the quantity of the recording operations is basically known based on the counted value of the dots (the number of times of discharges) discharged from the recording head 30, and the execution timing of wiping is determined according to the counted value. That is, it is determined whether or not the dot count value is a predetermined number or more, and when the dot count value becomes the predetermined value or more, wiping is performed. At that time, as illustrated in FIG. 6, the counted value is corrected based on a coefficient determined according to the density (duty) of the dots recorded in a region of a predetermined size and a record mode (number of passes and drive frequency).

Figures 9, 10:
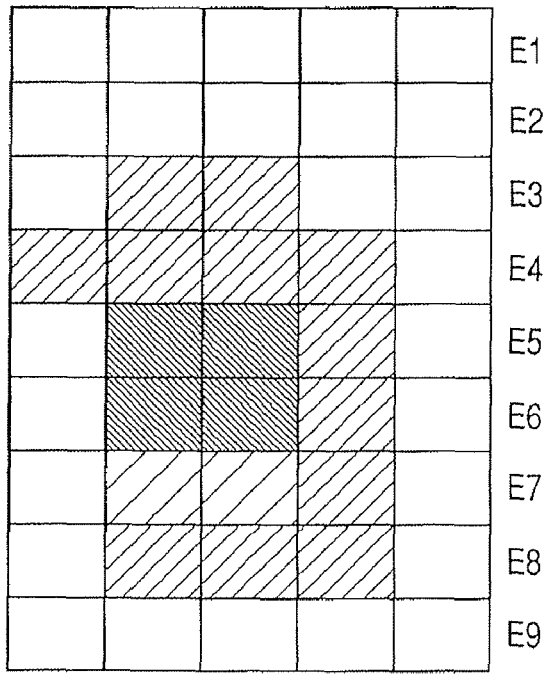
FIG. 9 is a diagram illustrating a table illustrating the relation between sheet-to-sheet spaces and correction coefficients according to the first exemplary embodiment.
FIG. 10 is a diagram illustrating an example of an image the dot duty of which is detected.

In FIG. 6, first, the dot data of the scan preformed before the present processing is obtained (step 601). Incidentally, at this time, the dot count value for the scan may be obtained from the obtained dot data, or the dot count may be obtained by the calculation of the number of dots during recording. Next, as illustrated in FIG. 10, the density (recording duty) of dots is detected every region (area) having a predetermined size (step 602). Each of the areas illustrated in FIG. 10 has a size of 100 pixels (dots)×150 pixels (dots). The dot data for one scan is divided into such areas, and the dot density (duty) is detected for each area. FIG. 10 illustrates the area arrangement of E1-E9 for the simplification of the illustration and the description thereof. It is a matter of course that the duty is actually detected for each divided area for one scan.

When the duty is detected, a coefficient is set for each area according to the duty thereof (step 603). The selection is performed with reference to the table illustrated in FIG. 7. The table corresponds to the easiness of the occurrence of the mist contaminations. The easier the condition in which the mist contaminations occur is, the larger the counted value becomes. Next, a dot count value weighted correspondingly to the easiness of the occurrence of the mist contaminations is obtained by the multiplication of the coefficient selected at the step 603 to the dot count value calculated for each area, and further the sum of the dot count values is obtained (step 604). At the step 604, the sum of the weighed dot count values is obtained as the dot count value since the execution of the wiping operation at the last time. Incidentally, the table is stored in the ROM 42 or in the nonvolatile memory 41.

Next, the calculation method of the dot count values will be described in detail. In the case of the image data (dot data) illustrated in FIG. 10, the number of dots and the duty in each area in each region are as follows.

| REGION | NUMBER OF DOTS | DUTY |
|---|---|---|
| E1 | 0 | 0% |
| E2 | 0 | 0% |
| E3 | 7500 | 50% |
| E4 | 7500 | 50% |

-continued

| REGION | NUMBER OF DOTS | DUTY |
|---|---|---|
| E5 | 15000 | 100% |
| | 7500 | 50% |
| E6 | 15000 | 100% |
| | 7500 | 50% |
| E7 | 3000 | 20% |
| | 7500 | 50% |
| E8 | 7500 | 50% |
| E9 | 0 | 0% |

E1: 0 dots

E2: 0 dots

E3: if 100% duty in one area, 100 × 150 = 15000 dots. Because one area in E3 is composed of 7500 dots 50% duty, the weighting coefficient of the table of FIG. 7 is 0.7. The weighted dot count value in one area of E3 is 7500 × 0.7 = 5250 dots. Because there are two 50% duty areas in E3, the weighted dot count value in the region of E3 can be obtained as 5250 × 2 = 10500 dots. Similarly, E4: 7500 dots × 0.7 × 4 = 21000 dots E5: 15000 dots × 1 × 2 + 7500 dots × 0.7 = 35250 dots E6: 15000 dots × 1 × 2 + 7500 dots × 0.7 = 35250 dots E7: 3000 dots × 0.05 × 2 + 7500 dots × 0.7 = 5550 dots E8: 7500 dots × 0.7 × 3 = 15750 dots E9: 0 dots Consequently, the total dot count value after the correction (weighting) of E1-E9 is 123300 dots.

On the other hand, the weighting of the dot count value according to a record mode is performed as follows.

First, record mode discrimination (step 605) is performed. In the present exemplary embodiment, 13 kinds of record modes having different numbers of passes and different drive frequencies (carriage (CR) speeds and the resolution of recording dots) of the recording head can be set as the record modes as shown in FIG. 8. The record modes can be set to correspond to, for example, the record modes that a user sets through the host computer. At the discrimination processing 605, the set record mode is discriminated. As to the number of passes, 1 pass means one pass mode in which the recording of a region corresponding to a scan width of the recording head is completed by one time of scan. Moreover, 2 passes or more means a multi-pass mode, wherein the scans of the number of passes are performed, the paper feed of the predetermined quantity during the scans are performed and thereby the record of the region corresponding to the scan width of the recording head is completed. Next, a coefficient is selected according to the discriminated record mode with reference to the table illustrated in FIG. 8 (step 606).

Next, the correction of the dot count value according to the record mode is performed by the multiplication of the coefficient obtained by the processing at the step 606 to the weighted dot count value obtained by the processing a the steps 601-604, and the result thereof is added to the cumulative counted value (step 607). For example, if the record mode of 8 passes illustrated in FIG. 8 is set and 0.08 is selected as the coefficient, then the sum 123300 dots of the corrected dot count value, which sum was obtained by the processing at the step 604, is multiplied by the coefficient 0.08, and 9864 dots can be obtained. The value is then added to the previous cumulative dot count value.

It is then determined whether the corrected dot count value obtained in such a way is larger than a predetermined threshold value or not (step 608). If the threshold value is set to 5000 dots, the corrected dot count value is 9848 dots without any cumulation in the example mentioned above, and is determined to be larger than the threshold value. If the corrected dot count value is determined to be less than the threshold value in the determination, the present processing is ended, and the next scan is performed without performing any wiping. Moreover, if the corrected dot count value is determined to be larger than the threshold value, the recording head is moved to the position of the wiper blade 3, and wiping is performed. Moreover, the dot count value is cleared (step 609).

As described above, the timing of executing wiping is determined based on the dot count value weighted according to the duty of recording dots and a record mode. Thereby, wiping can be performed at the timing adapted to the degree of the contamination of the discharge port surface of the recording head. That is, even if an uncorrected dot count value exceeds the threshold value, the adherence of ink or the like on the discharge port surface can be not so bad in some recording duty or some record mode, and in such a case no wiping is essentially needed. According to the present invention, the counted value of discharged dots is multiplied by a weighting coefficient corresponding to easiness to contaminate on the discharge port surface. Thereby, in the above-mentioned case, the counted value does not exceed the threshold value for the execution of wiping operations, and no wiping operations are performed. Consequently, the wiping operation can be performed at the time when it is needed because of the contamination of the discharge port surface, and the density unevenness caused by the time difference owing to the decrease of the deterioration of throughput and the insertion of the execution of wiping between scans can be reduced.

In concrete terms, as illustrated in FIG. 7, if the duty of dots is low, the contamination of the discharge port surface is not so bad, and the correction coefficient is accordingly reduced. Moreover, as illustrated in FIG. 8, in the case where the number of passes is large or the drive frequency (CR speed× resolution) is low, the contamination of the discharge port surface is not so bad, and the correction coefficient is accordingly made to be small. The larger the number of passes becomes, the smaller the recording duty recorded at one recording scan is. In the case where the number of passes is large, the correction coefficient is made to be small. Thereby, the wiping can be performed at the timing adapted to the degree of the contamination of the discharge port surface of the recording head.

Incidentally, in addition to the recording conditions illustrated in FIGS. 7 and 8, the correction coefficient may be multiplied according to the distance between the discharge port surfaces of the recording head and the recording medium (the distance from the sheet), as illustrated in FIG. 9. As illustrated in FIG. 9, the smaller the distance between the discharge port surface and the recording medium, the smaller the coefficient is made to be. That is, in the printer of the present exemplary embodiment, it is confirmed that the smaller the distance between the discharge port surface and the recording medium, the less the contamination of the discharge port surface is.

Moreover, although the coefficients according to the recording conditions illustrated in FIGS. 7, 8, and 9 are cumulatively multiplied in the example described above, it is a matter of course that the correction may be performed according to one of the recording conditions illustrated in those figures.

Second Exemplary Embodiment

Figures 11, 12:
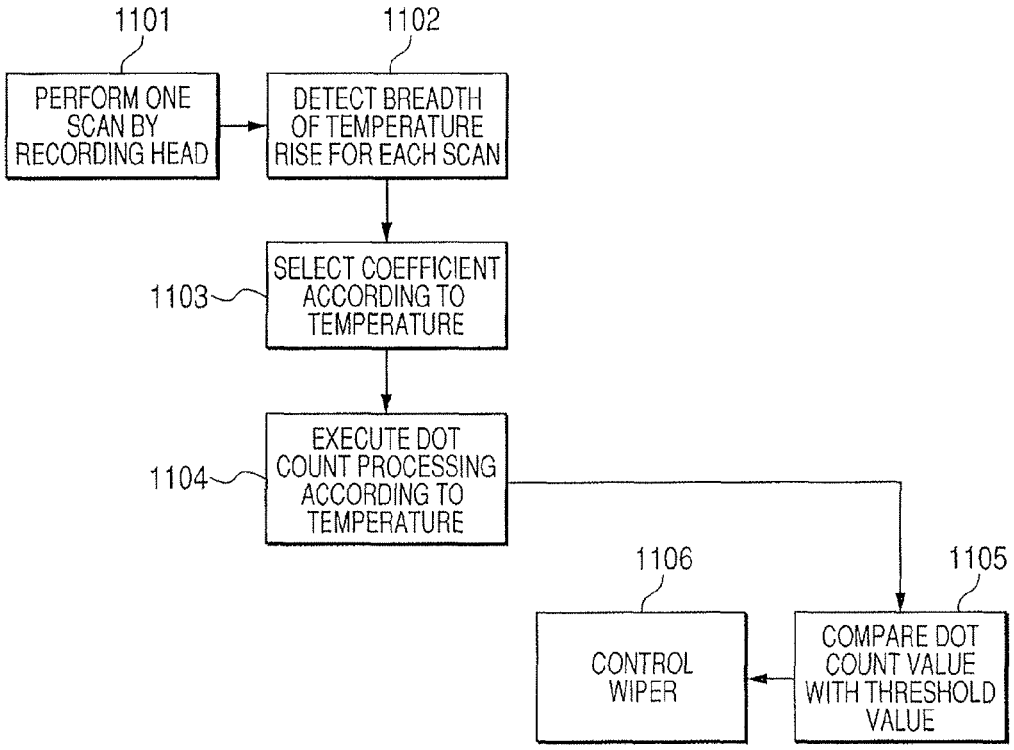
FIG. 11 is a block diagram illustrating the processing or the configuration for determining the execution timing of wiping, one of the discharge recovery processings according to a second exemplary embodiment of the present invention.
FIG. 12 is a view illustrating a table illustrating the relation between head temperature rise and correction coefficients according to the first exemplary embodiment.

FIG. 11 is a block diagram illustrating the processing or the configuration for determining the execution timing of wiping according to a second exemplary embodiment of the present invention. In the following, the different parts from those of the processing or the configuration illustrated in FIG. 6 will be mainly described.

At the time of one time of scan of the recording head (step 1101), the highest temperature among the temperatures, during the scan, detected by the temperature sensor built in the recording head is stored, and the breadth of temperature rise Δt is determined (step 1102). The table illustrated in FIG. 12 is referred to and a coefficient is selected according to the breadth of temperature rise Δt (step 1103). Next, the number of dots counted by the scan is multiplied by the selected coefficient, and the result is added to the previous cumulative counted value (step 1104). It is then determined whether the thus obtained dot count value is larger than the threshold value or not (step 1105).

According to the processing described above, the timing of wiping can be determined with a relatively simple configuration of temperature detection, and consequently the soft processing can be simplified.

According to the exemplary embodiments of the present invention, wiping can be performed at the optimum timing adapted to the state of the discharge port surface of the recording head as described above. Consequently, the prevention of density unevenness in a recorded image can be performed without producing the long interruption of a recording operation owing to wiping.

Other Exemplary Embodiment

Incidentally, although the cases where the present invention is applied to the determination of the execution timing of wiping have been described in each of the exemplary embodiments, the application of the present invention is not limited to the determination of the execution timing of the wiping. For example, the present invention can be similarly applied to the determination of the execution timing of a preliminary discharge and an absorption recovery. That is, the present invention can be also applied to a recording apparatus of the system in which the preliminary discharge or the absorption recovery is performed every several times of scans. In this case, the coefficients can be determined according to how much the recording head needs the preliminary discharge or the absorption recovery. Moreover, it is a matter of course that the execution timing of the recovery processing in this case is not limited to that of being basically determined based on the dot count value like the exemplary embodiments described above. For example, a time interval or the like may be adopted as the thing indicating such a quantity of recoding operations, and the configuration of correcting the time interval by a coefficient obtained according to the recording condition corresponding to the degree of the necessity of a discharge recovery may be adopted.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2006-168009, filed Jun. 16, 2006, which is hereby incorporated by reference herein in its entirety.

What is claimed is:

1. An ink jet recording apparatus that performs recording by discharging an ink from a recording head to a recording medium, comprising:

a recovery unit for performing wiping as discharge recovery processing for maintaining a discharge performance of the recording head;

a count unit that counts discharge amounts of the ink discharged from the recording head, each discharge amount corresponding to ink discharged onto a predetermined region;

a calculation unit that calculates a sum of values obtained by multiplying the discharge amounts onto the predetermined regions by coefficients determined in accordance with ink discharge densities of the predetermined regions; and a determining unit for determining execution timing of the discharge recovery processing by the recovery unit based on the sum calculated by the calculation unit.

2. The ink jet recording apparatus according to claim 1, wherein the control unit determines the execution timing of the discharge recovery processing based on the discharge amount of the ink for each predetermined region discharged from the recording head and a parameter indicating a contamination state of the recording head.

3. The ink jet recording apparatus according to claim 1, wherein the control unit determines the execution timing of the discharge recovery processing by comparing a value obtained by multiplying the discharge amount of the ink for each predetermined region by a coefficient with a threshold value.

4. The ink jet recording apparatus according to claim 3, wherein the control unit determines the timing of executing the discharge recovery processing to the time when the value obtained by multiplying the discharge amount by the coefficient reaches the threshold value to control the discharge recovery processing to be executed.

5. The ink jet recording apparatus according to claim 1, wherein the timing of executing the discharge recovery processing changes according to whether a recording dot density for each predetermined region is large or small.

6. The ink jet recording apparatus according to claim 5, wherein, when the recording dot density for each predetermined region is large, the timing of executing the discharge recovery processing is earlier than the timing when the recording dot density for each predetermined region is small.

7. The ink jet recording apparatus according to claim 1, wherein the control unit determines the execution timing of the discharge recovery processing by the recovery unit based on a drive frequency of the recording head.

8. The ink jet recording apparatus according to claim 1, wherein the control unit determines the execution timing of the discharge recovery processing by the recovery unit based on a number of times of scans when the recording in a definite region is completed by a plurality of scans of the recording head.

9. The ink jet recording apparatus according to claim 1, wherein the control unit determines the execution timing of the discharge recovery processing by the recovery unit based on amount of rise temperature of the recording head during a definite period.

10. A discharge recovery method for performing wiping as discharge recovery processing for maintaining a discharge performance of a recording head in an ink jet recording apparatus that performs recording by discharging an ink from the recording head to a recording medium, the method comprising the steps of:

counting discharge amounts of the ink discharged from the recording head, each discharge amount corresponding to ink discharged onto a predetermined region;

calculating a sum of values obtained by multiplying the discharge amounts onto the predetermined regions by coefficients determined in accordance with ink discharge densities of the predetermined regions;

determining execution timing of the discharge recovery processing based on the sum calculated in the calculating step.

* * * * *